United States Patent [19]

Olliges

[11] Patent Number: 4,648,600

[45] Date of Patent: Mar. 10, 1987

[54] VIDEO SLOT MACHINE

[75] Inventor: William E. Olliges, Barrington Hills, Ill.

[73] Assignee: Bally Manufacturing Corporation, Chicago, Ill.

[21] Appl. No.: 654,916

[22] Filed: Feb. 3, 1976

Related U.S. Application Data

[63] Continuation-in-part of Ser. No. 482,742, Jun. 24, 1974, abandoned.

[51] Int. Cl.[4] ..... A63F 9/22

[52] U.S. Cl. ..... 273/138 A; 273/85 G; 273/DIG. 28

[58] Field of Search ..... 273/1 E, 85 R, 138 A, 273/143 R, 143 A, 143 C, DIG. 28; 178/6.8; 235/92 GA; 340/172.5, 323 R, 323 B, 324 R, 324 B, 112.5, 324 A, 324 AD

[56] References Cited

U.S. PATENT DOCUMENTS

| | | | |
|---|---|---|---|
| 3,082,294 | 3/1963 | Dean | 358/142 |
| 3,639,736 | 2/1972 | Sutherland | 340/724 X |
| 3,680,077 | 7/1972 | Hoberecht | 340/726 |
| 3,728,480 | 4/1973 | Baer | 273/DIG. 28 |
| 3,770,269 | 11/1973 | Elder | 273/138 A X |
| 3,819,186 | 6/1974 | Hinterstocker | 273/138 A |
| 3,822,363 | 7/1974 | Moyer et al. | 340/324 AD |
| 3,874,669 | 4/1975 | Ariano et al. | 273/85 R |
| 3,929,338 | 12/1975 | Busch | 273/138 A |
| 4,095,795 | 6/1978 | Saxton et al. | 273/138 A X |

FOREIGN PATENT DOCUMENTS

| | | | |
|---|---|---|---|
| 280649 | 4/1967 | Australia | 273/138 A |
| 1082557 | 9/1967 | United Kingdom | 273/138 A |

OTHER PUBLICATIONS

*Radio Electronics;* "Electronic Casino"; Mar., 1974; pp. 45, 50–52, 86.

*Radio Electronics;* "Electronic Casino"; Apr., 1974; pp. 58, 59.

*Primary Examiner*—Richard C. Pinkham

*Assistant Examiner*—MaryAnn Stoll Lastova

*Attorney, Agent, or Firm*—Jenner & Block

[57] ABSTRACT

An electronic amusement device is provided in which a set of symbols is displayed on a cathode ray tube. A set of winning symbols is also displayed in response to selection by a player. Upon actuation of a lever arm by the player, the first-mentioned set of symbols is randomized and the resulting display is compared with the selected winning symbols. A reward output is provided in response to match of one or more of the randomized symbols with the selected winning symbols.

22 Claims, 11 Drawing Figures

+5 V IN
GND
4 MHZ
2 MHZ
VARIABLE PULSE RATE GENERATOR
CLOCK-46
GO
VAR ENABLE
STATE SEQUENCER
48
50A
54
48-2
48-1
7442
7493
START
49C
49C1
ENABLE &
A B X
V1
V2
V3
37
SYMBOL LOAD
SELECTED SYMBOL STORAGE
80
80-1
80-2
80-3
80-4
80-5
7496
8MHZ
H1
H2
H3
37-1
37-2
37-3
37-4
37-5
37-6
37-7
I1
I2
I3
I4
I5
V SYNC
ASC II KEYBOARD
36
ROW 1
ROW 2
ROW 3
ROW 4
COL 1
COL 2
COL 3
COL 4
COL 5
COL 6
COL 7
COL 8
49A
49A-2
49A-3
49A-4
49A-5
49A-6
49A-7
49A-8
GAME ON
NO GAME OVER
STOP
ENABLE & START
24
START

COL5
COL4
COL3
COL2
COL1
R CLOCK
TOP
V3
V BLANK1
V2
V BLANK2
V1
V BLANK3
BOTTOM
V ROW
V SYNC
VID ENABLE
H BLANK
HJ
8 PPC
SR CLOCK
7.8 KHZ
AUX VID
AJ
BJ
CJ
HC
125KHZ
H1
H2
H3
H4
H5
H6
H SYNC
H END
8 PPF
22 COUNT
72
DECODER
72-2
DECODER
H1-HJ
76A
DECODER
76B
74-3
74
DECODER V1-V3
74-2
74-1
74-4
72-1
70-1
70-2
70-3
70-4
DECODER
76C
DIVIDERS
70
+5
H COIN
HB
HC
2MH2
+5V IN
GRD

ABX
S2
S3
S4
S1
S6
S5
GATES 52C-1 52C
50-3
+5
52B-5
50-5
52B-2
GATES
52B
50-1
52B-4
RANDOMIZER R2
52B-1
RANDOMIZER R1
R1-1
52B-3
RANDOMIZER R3
R3-1
50-2
50-6
50-4
VARIABLE PULSE RATE GENERATOR 50
GATES 52A
4MHZ
SO
R CLK
+5 VX
VAR 1
VAR 2
8PPF
VAR 3
GO
VSYNC
S2
S6
S4
S3
S1
S5
S7
VAR ENABLE
S1

ROW B
ROW A
R CLOCK
CH 3
CG 1
ROW C
NULL
56A-1
CG 3
CG 2
CHARACTER GENERATOR & MULTIPLEXER
CG 5
CG 4
56A
W3B-1
W2B-1
W1B-1
WHEEL W3B
WHEEL W2B
WHEEL W1B
WHEEL W3A
WHEEL W2A
WHEEL W1A
W1A-1
W1A-2
W2A-1
W2A-2
W3A-1
W3A-2
7493
7415
7416
7461
+5
HJ
V2
V1
VAR 1
8PPC
GAME OVER
HEND
22 COUNT
P1
BJ
VAR 2
P3
AJ
VAR3
H3
P5
CJ
P2
P4

ROW A
ROW B
ROW C
VID ENABLE
NV
MATCH
VID OUT
VID GND
56B-2
74151
56B-3
56 B
58A
60
CHARACTER GENERATOR
SYMBOL COMPARATOR
VIDEO MODULATOR
56 B 1
TMS 4103
56B-4
56B-5
-12 V
+12 V
COL 5
CG 1
COL 4
CG 2
COL 3
CG 3
COL 2
CG 4
COL 1
CG 5
NULL
V 1
P 1
P 2
P 3
P 4
P 5
V SYNC
H SYNC
AUX VID

GAME OVER
H COIN
LAMP 42-1
LAMP 42-2
LAMP 42-3
LAMP 42-4
LAMP 42-5
J P LATCHED
SOUND
M&S RELAY
PAYOFF COMPUTATION & CONTROL 62
SOUND
SOUND
SOUND
SOUND
ON PAYOFF LINE BLOCKS SINGLE PAYOFF
HB
STOP
ENABLE & START 49B
49B-1
62-1
64
58B-1
58B-2
58B-3
58B-4
SO
NC
34
NO
GAME ON
H1
H2
H3
H4
H5
S8
V SYNC
5
JP RESET
V ROW
COL 3
HC
HJ
MATCH
SYMBOL COMPARATOR 58B
NV
66
NC
NO
(PAYOFF SWITCH)
PAYOFF TEST

VIDEO SLOT MACHINE

This application is a continuation-in-part of the copending U.S. application patent Ser. No. 482,742, filed June 24, 1974, now abandoned.

BACKGROUND OF THE INVENTION

The present invention relates to an amusement device having an electronic display and utilizing electronic circuitry.

One popular game is played on a device commonly known as a "slot machine". Mechanical slot machines are widely known throughout the world.

The conventional slot machine is constructed of a large number of gears, wheels, mechanical timers and other elements which operate conjunctively to provide an appropriate display and reward. The typical slot machine, which has not changed dramatically over the past 40 years, presents a display of three symbols at a time, each of which symbols is printed on a wheel which rotates in a random manner when the slot machine is actuated. Certain combinations of symbols represent winning combinations. For example, if three identical symbols are displayed when the three wheels stop, the player has a winning combination. The device typically has instructions printed thereon showing various winning combinations.

Prior art slot machines have certain drawbacks. First, the mechanical components thereof tend to wear and may cause serious service problems. The necessity for reliable operation of a slot machine is apparent, and it is desirable to avoid problems of dynamic balance, lubrication, differential friction and mechanical timers.

Second, the slot machine itself dictates what the winning combination of symbols is, and the player cannot easily vary the program based upon his own choice.

Third, prior art slot machines are limited in the number of symbols which can be displayed and some machines are not adaptable to multiple play. Thus, the conventional slot machine is primarily adapted to but a single play for each actuation of the handle, although it is believed that many players would prefer multiple play, where a plurality of combinations are tested upon each actuation of the handle, if the odds of winning were to increase proportionally.

It is therefore an object of the present invention to provide an electronic amusement device that is exciting and stimulating to the operator.

A further object of the invention is to provide an electronic amusement device which utilizes solid state electronic circuitry.

Another object of the present invention is to provide an electronic amusement device which displays symbols in a random manner on a cathode ray tube.

Another object of the present invention is to provide an electronic amusement device which obviates the problems concomitant with devices requiring gears, wheels, mechanical timers and other mechanical elements.

A still further object of the present invention is to provide an electronic amusement device in which the player has the opportunity to select winning symbols. Thus the player may select a combination of letters corresponding to his initials and then try to match one or more of these initials.

A further object of the present invention is to provide an electronic amusement device that is adapted for multiple operation, whereby the odds of winning can be increased.

Another object of the present invention is to provide an electronic amusement device which is relatively simple in construction and efficient to manufacture.

A still further object of the invention is to provide an electronic amusement device which is simple for the player to utilize and is reliable in operation.

Other objects and advantages of the present invention will become apparent as the description proceeds.

BRIEF DESCRIPTION OF THE INVENTION

In accordance with the present invention, there is provided an electronic amusement device including electronic display means in the form of a cathode ray tube. Means are provided for displaying at least one of a plurality of symbols on the cathode ray tube. Means are provided for selecting a winning symbol. While the selection of a winning symbol may be made by the manufacturer or by the owner of the device, in the preferred embodiment of the invention, the player is given access to the means for selecting the winning symbol as this gives the player greater participation and greater control and hence greater enjoyment. Means are further provided for randomizing the displayed symbol, and means are provided for actuating operation of the randomizing means. The electronic amusement device also includes reward output means responsive to random display of a symbol which matches the selected winning symbol.

In the illustrative embodiment, means are responsive to the randomizing means and operable to provide a simulated rolling effect to symbols displayed on the cathode ray tube. Further, the means for selecting a winning symbol preferably includes a manually operable keyboard located on an external surface of the electronic amusement device and accessible to the player.

In the illustrative embodiment, the electronic amusement device comprises a housing having a lever arm pivotally connected at its side and a cathode ray tube on its face. The cathode ray tube normally displays a set of symbols. A manually operable keyboard is carried by the housing and is operable by the player to select winning symbols and to display these winning symbols on the cathode ray tube.

In the illustrative embodiment, after the player enables the device, he presses the keys of the keybbard to display his preferred winning symbols on the lower portion of the cathode ray tube. The player then pulls the lever arm and the symbols displayed on the upper portion of the cathode ray tube appear to spin. It is to be understood that the "upper portion" and the "lower portion" could comprise two separate cathode ray tubes. Indeed, the "lower portion" need not comprise a cathode ray tube at all. Other electronic displays, such as light emitting diodes or liquid crystal readouts, may be employed for indicating the winning symbols. When the "spinning" symbols stop, if one or more of those symbols matches the corresponding aligned selected symbol, the player is considered to have won. As noted above, in the preferred embodiment of the invention, the player can choose his own winning combination, and this is believed to increase his enthusiasm for the game because it increases his participation therein.

A more detailed explanation of the invention is provided in the following description and claims, and is illustrated in the accompanying drawings.

DETAILED DESCRIPTION OF THE ILLUSTRATIVE EMBODIMENT

Figure 1:
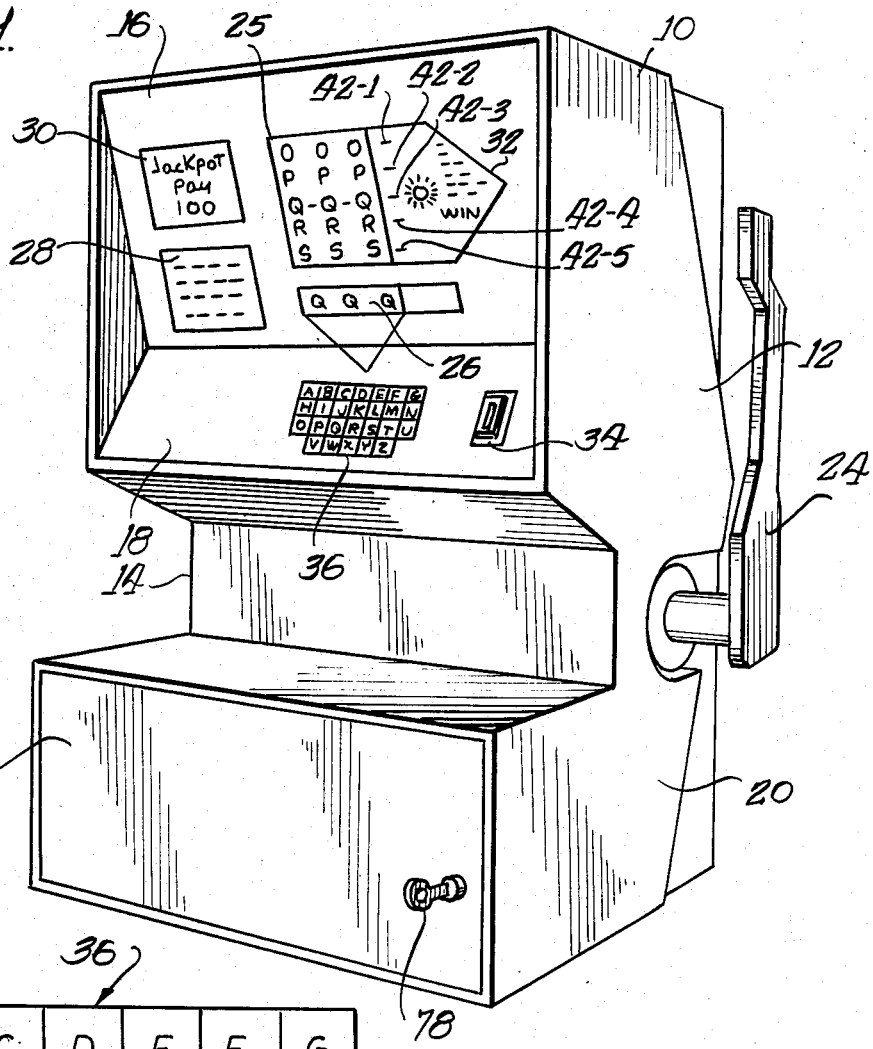
FIG. 1 is a perspective view of an electronic amusement device constructed in accordance with the principles of the present invention.

Referring to FIG. 1, the electronic amusement device shown therein comprises a housing 10 having a pair of sides 12, 14, an upper face 16, a lower face 18, and a base 20 having a base front 22. A lever-actuated start switch 24 is pivotally connected to the side 12 of the housing 10 and is operable to actuate the randomizing operation of the device, as will be explained in detail below. A cathode ray tube 40 is located within the housing behind upper face 16, and the display on the cathode ray tube is shown through an upper window 25 and a lower window 26. The portions of upper face 16 other than windows 25 and 26 are generally opaque to provide an attractive appearance and mask the unused portions of the cathode ray tube. Upper face 16 also carries descriptive indicia, including instructions 28, reward indicator 30 and additional copy 32.

Lower face 18 has an enabling mechanism 34 and a manually operable keyboard 36.

Figure 2:
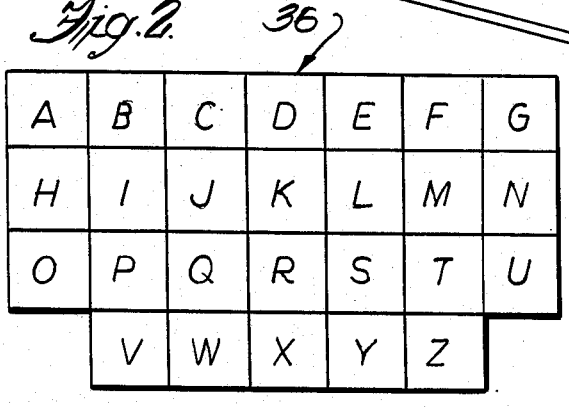
FIG. 2 is a front view of the keyboard utilized by the electronic amusement device of FIG. 1.

Referring to FIG. 2, it is seen that the keyboard 36 is laid out alphabetically instead of in the manner of a conventional typewriter. This is preferable to enable persons unfamiliar with a typewriter to have rapid access to the desired symbol. In the illustrative embodiment, the symbols available and displayed are the letters of the English alphabet. As is described below, an additional "wild" symbol is utilized, and in the illustrative embodiment, the "wild" symbol comprises an asterisk (*).

Figure 3:
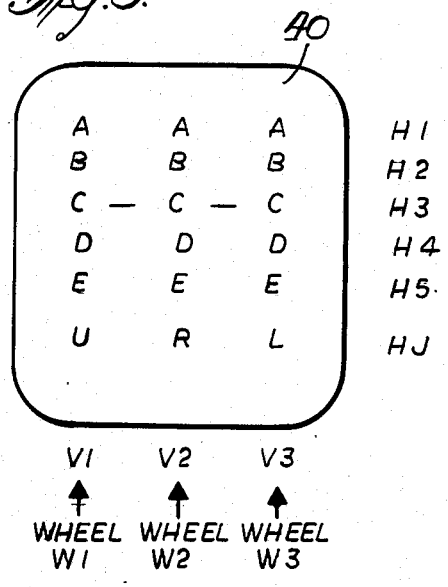
FIG. 3 is a schematic diagram of the cathode ray tube display of the amusement device illustrated in FIG. 1.

Referring to FIG. 3, the cathode ray tube 40 is shown therein having an upper display formed of five horizontal rows of three characters and a lower display formed of one horizontal row of three characters, with each of the characters of each row being aligned vertically with a character of the adjacent row.

For purposes of clarity, the first horizontal row (AAA) is designated H1, the second row (BBB) is designated H2, the third row (CCC) is designated H3, the fourth row (DDD) is designated H4, the fifth row (EEE) is designated H5 and the bottom row (URL) is designated HJ. The left vertical column is designated V1, the middle vertical column is designated V2 and the right vertical column is designated V3.

It is preferred that the visual display always be present on the cathode ray tube, so long as the apparatus is electronically energized. When the enabling mechanism 34 is first operated, row H3 becomes the "payoff" line and a signal line 42-3 (FIG. 1) is illuminated to indicate the payoff line. Other signal lines 42-1, 42-2, 42-4 and 42-5 are provided to indicate other payoff lines which are in operation. Thus upon a second operation of the enabling mechanism 34, row H2 also becomes a payoff line. Upon a third operation of the enabling mechanism 34, row H4 becomes a third payoff line. Likewise, fourth and fifth operations of the enabling mechanism 34 will make available rows H1 and H5, respectively, as additional payoff lines.

Prior to actuation of lever-actuated start switch 24, the displays on the payoff lines will not change. After one or more operations of the enabling mechanism 34, the player manually presses three of the keys on keyboard 36 to preselect a winning line HJ. Any combination of three keys is acceptable, as is three of the same letter if desired. If no keys are pressed, the combination remains the same as before. If one key is depressed, the first symbol changes to that corresponding to the selected key, while the second and third symbols change to asterisks, whence they are changed again upon subsequent depressions of the selector keys.

After the operation of the enabling mechanism 34 and the winning line HJ has been selected by the player, the player pulls lever-actuated start switch 24 in the conventional manner that a lever arm of a slot machine is pulled. The electronic circuitry is such that the payoff lines thereupon appear to spin and at the same time sound effects are provided for added enjoyment. After several seconds the payoff lines appear to come to rest and new sets of symbols are displayed as rows H1 through H5. This display is randomized, as will be described in detail below. The symbols of winning line HJ are compared with the aligned symbols of the payoff line or lines and matching symbols are considered wins. Such wins are rewarded by an appropriate display 30, and/or by other means.

If all of the letters of win row HJ match all of the letters of any one of the payoff lines, the player has hit the "jackpot". Display 30 will illuminate, and interesting sound effect such as bells or sirens, may be programmed to occur.

Figure 4:
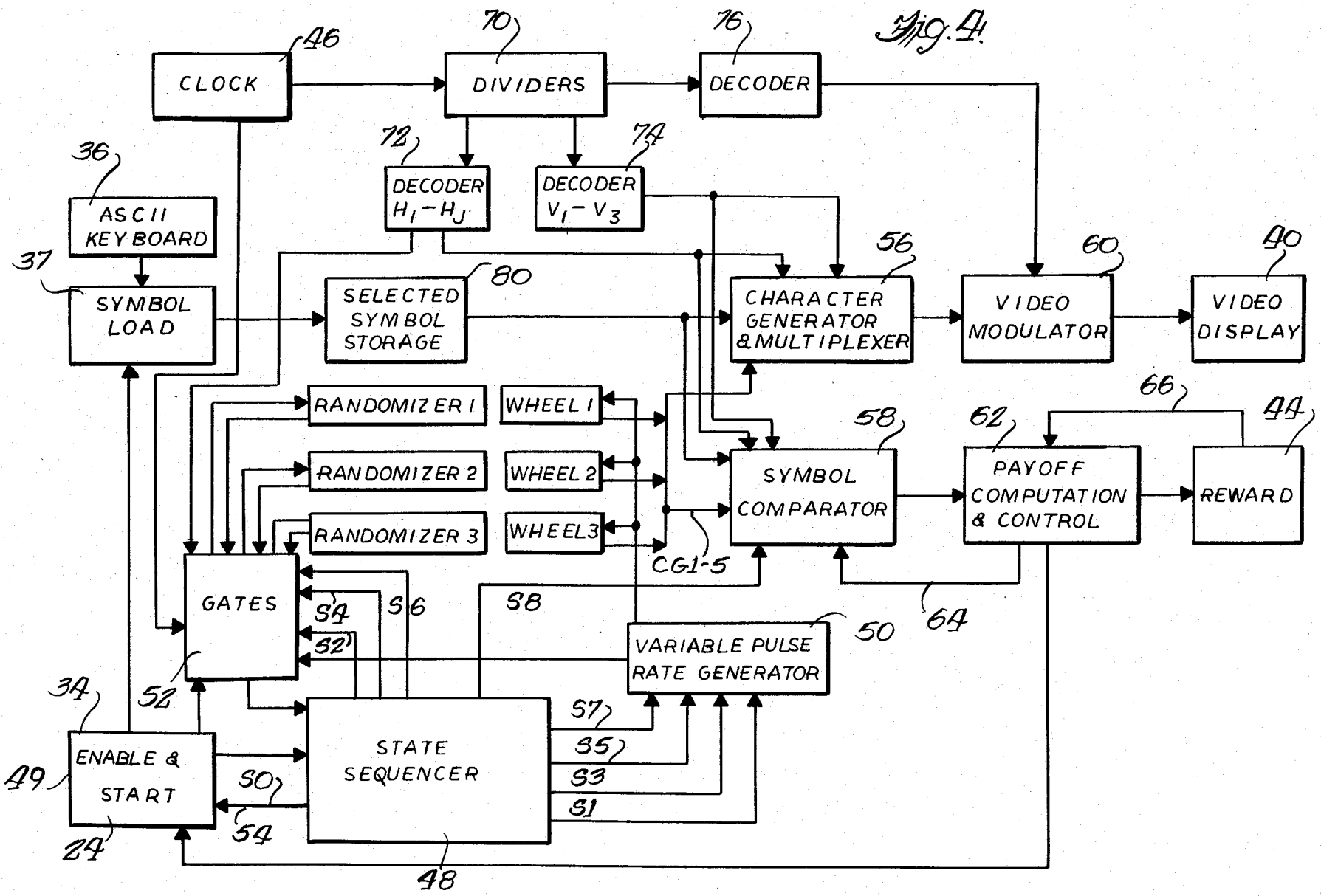
FIG. 4 is a block diagram of the circuitry of the electronic amusement device of FIG. 1.

The electronic operation of the device can be understood by the following discussion and by referring to the block diagram of FIG. 4 and the more detailed circuit diagrams of FIGS. 5 to 10.

The electronic system has essentially three external signal inputs—the enabling mechanism 34, the keyboard 36 and the lever-actuated start switch 24. For convenience, the enabling mechanism 34 and the lever actuated start switch 24 are shown in the same box 49 in FIG. 4. The system has two gross signal outputs —a video display 40, and a reward dispenser 44.

The TTL and MOS internal circuitry is synchronized by a highly stable quartz crystal clock 46. This provides both an extremely stable video display and precise control of the "wheel" acceleration, maximum speed rotation, and deceleration characteristics. The term "wheel" refers to a binary counter which, after suitable electronics, results in display of the simulated effect of a wheel that is "spinning" about a horizontal axis. This effect is observed by the player when he pulls lever-actuated start switch 24 and views the characters displayed n the upper window 25.

The gross operation of the machine is controlled by a nine-state sequencer 48 which enables, starts and stops certain functions as appropriate during each play of the machine. The operation of video display 40 and other ongoing functions continues irrespective of the state of sequencer 48. The following State Number versus Function table illustrates the sequential operation of the machine, with the various elements being discussed in more detail below:

| STATE NO. | FUNCTION | EVENT WHICH ADVANCES STATE |
|---|---|---|
| S0 | Quiescence until enabled by mechanism 34. Then enable keyboard 36 and start 24 inputs. | Lever arm pulled. |
| S1 | Disable all inputs. Accelerate "wheels" W1, W2 and W3. | Wheels accelerated to maximum speed. |
| S2 | All wheels spinning at maximum speed. Enable randomizer R1. | Randomizer R1 overflows. |
| S3 | Decelerate wheel W1. Wheels W2 and W3 spinning at maximum speed. | Wheel W1 stops. |
| S4 | Wheels W2 and W3 spinning at maximum speed. Enable randomizer R2. | Randomizer R2 overflows. |
| S5 | Decelerate wheel W2. Wheel W3 spinning at maximum speed. | Wheel W2 stops. |
| S6 | Wheel W3 spinning at maximum speed. Enable randomizer R3. | Randomizer R3 overflows. |
| S7 | Decelerate wheel W3. | Wheel W3 stops. |
| S8 | Compare letters on payoff line to corresponding letters selected by player. Compute and perform payoff. | Payoff (if any) completed. |

The circuitry of the illustrative embodiment is digital. In this manner, the operation of the device is absolutely deterministic, although randomizers are effectively used to overcome the single event deterministic result. This type of system obtains high reliability and independence from mechanical vagaries.

Referring to FIG. 4, it can be seen that the enable and start circuit 49 is coupled to the symbol load circuit 37 and through gates 52 to the state sequencer 48. The state sequencer 48 is fed through gates 52 to randomizer R1, randomizer R2 and randomizer R3. The state sequencer 48 is also fed to a variable pulse rate generator 50, and a feedback through gates 52 from the variable pulse rate generator 50 to the state sequencer 48 is provided. Clock pulses from the clock 46 are applied through the gates 52 to the randomizers R1, R2 and R3. The randomizers R1, R2 and R3 feed back to the state sequencer 48 via the gates 52. The state sequencer 48 also feeds back to enable and start circuit 49 via a line 54. The lines from the state sequencer 48 are numbered in accordance with the respective state signal numbers S0-S8, as per the above State No. vs. Function chart.

The variable pulse rate generator 50 applies drive pulses to wheels W1, W2 and W3, respectively, with the output of wheels W1 W2 and W3 being fed to a character generator and multiplexer 56 and to a symbol comparator 58. The character generator and multiplexer 56 feeds to a video modulator 60 which feeds to the video display 40. The symbol comparator 58 feeds to a payoff computation and control 62 which feeds to the reward dispenser 44, which may include the reward indicator 30. The payoff computation and control 62 feed back to the symbol comparator 58 via a line 64, and the reward dispenser 44 feeds back to the payoff computation and control 62 via a line 66.

The quartz crystal clock 46 drives a timing chain formed of a binary divider string 70 which feeds to an H1–HJ decoder 72 and a V1–V3 decoder 74. The divider 70 also outputs to a decoder 76 which feeds to the video modulator 60. The decoders 72 and 74 feed to the character generator and multiplexer 56 and to the symbol comparator 58.

The keyboard 36 loads selected symbols into a selected symbol storage circuit 80 through the symbol load circuit 37, when the latter is enabled by a signal from the enable and start circuit 49.

SUMMARY OF OPERATION

The game is in its quiescent state until the enabling mechanism 34 is operated. In this quiescent state, the various symbols appear stationary on the face of the cathode ray tube 40 as shown in FIG. 3, being in rows H1 to HJ, and columns V1 to V3. As a matter of convenience, the particular circuitry utilized in the present invention requires the cathode ray tube to be turned clockwise 90° (as viewed from the front) from its conventional position in television. Thus, the raster scan of the cathode ray tube 40, as shown in FIG. 3, proceeds in lines from top to bottom, beginning in the upper right hand corner with the lines being traversed successively from right to left. Because the game is designed to be utilized with conventional television cathode ray tubes and conventional television circuitry as a matter of economy, the description of the scanning and the necessary synchronization signals will be described following the conventional television practice where the horizontal sync refers to the line synchronization and the vertical sync refers to frame synchronization, even though the lines as viewed in FIG. 3 appear vertical.

The clock 46 operates through the divider 70 and the decoder 76 to generate the necessary horizontal sync pulses at a rate of 15,600 PPS and vertical sync pulses at a rate of 60 PPS, these being the frequencies for conventional television. They may be connected through the video modulator 60 to control the scanning of the cathode ray tube display unit 40 with the latter incorporating standard television components. That is, the horizontal and vertical sync pulses are generated at frequencies compatible with standard television circuitry as a matter of economy.

Standard television scanning provides 260 lines per frame. Hence, the raster as shown in FIG. 3 is 260 lines wide. The video display of the present invention is 256 increments high. The symbols to be displayed are ASCII characters on a 5 by 7 matrix, with each square of the matrix being four lines wide and four increments high. One square is left blank between characters in the vertical direction. Thus, each character requires eight squares each four increments high providing, therefore, eight horizontal slots. Slots 2, 3, 4, 5 and 6 are allotted to characters H1 to H5, respectively. Line HJ is in slot 7½, leaving a blank half-slot between line H5 and line HJ and a half-slot after line HJ, with a full-slot before line H1. The interval between slots HJ and H1 are available for horizontal sync and back porch fly-back time. Each character is five squares wide, with each square consisting of four lines. Thus, each character is 20 lines wide, providing 13 vertical columns, with V3 in column 3, V2 in column 7 and V1 in column 11. Hyphens indicating a payoff line appear in columns 5 and 9.

The timing and synchronizing pulses are derived from pulses from the quartz crystal clock 46, to which all of the logic is slaved. Pulses from the clock 46 drive the timing chain 70 which is a binary divider string. The timing chain provides the H1 through HJ horizontal position gates and the horizontal sync pulses to the video display at a 15,600 PPS rate. The 15,600 PPS is then divided down to 60 PPS for vertical sync and frame refreshment. As part of this division, the vertical position gates V1, V2 and V3 are developed. These horizontal and vertical position gates are used to define and thus multiplex to the character generator each of the 18 characters to be displayed on the face of video display 40.

Wheels W1, W2 and W3 accelerate to a rate of 60 characters per second, fast enough so that the introduction of variability (or randomization) as described below does not noticeably increase the spin time, yet slow enough that the display at miximum wheel rotation rate is stable and without "smear", using a conventional raster scan television-type display with a P4 or similar type phosphor and a 60 Hz frame rate.

Wheel W, wheel W2 and wheel W3 each comprises a five bit binary 27-state (0–26) counter. The five bits from each counter are interpreted as ASCII characters. Thus, 00001 (1) corresponds to "A", 11010 (26) corresponds to "Z", and 00000, which is ASCII "@", is decoded as a special case as an asterisk ("*").

In the quiescent state when the wheels are stationary on the display), as the raster scan sweeps past the beginning of each of the horizontal position gates (H1 through H5), each of the Wheel counters is incremented by one count such that five sequential letters are displayed for each wheel. During HJ time, not only are the contents of the symbol storage register multiplexed into the character generator for display, but each of the three wheel counters is incremented by 22 additional counts. Thus, each of the wheel counters will contain the same count at the top of the next frame as it had at the top of the previous frame and the display will therefore appear stable. To cause the wheels to "roll", additional clock pulses are added as appropriate and as described below.

The interplay variability, or randomization, results from the operation of randomizer R1, randomizer R2 and randomizer R3. In the absence of the randomizers, the operation would clearly be completely deterministic and therefore predictable.

Each randomizer is a five-bit binary counter with a count length of 27 (0–26). The three counters are cascaded and driven at a four mega-bit per second rate beginning when the last play ended. Each of the counters therefore cycles completely at least once every five milliseconds. The start of the next play stops the counters. The count state they happen to be in when play begins is thus totally random so far as the player is concerned. As each play begins, each of the three randomizers thus contain some random count, the initial state being determined by the exact moment the pay starts relative to when the last play ended.

To illustrate the operation of the randomizers, assume that randomizer R1 is stopped at a count of 3, that randomizer R2 is stopped at a count of 21 and that randomizer R3 is stopped at a count of 16. When wheel W1 reaches its maximum speed of 60 characters per second, as each new letter crosses the payoff line, the randomizer R1 has advanced one count. When it overflows (26—0), the deceleration of wheel W1 begins. Wheel W1 will therefore spin at it maximum rate in this example for exactly 23/60 seconds, that is, until 23 letters (26—3) have crossed the payoff line. When wheel W1 stops, wheel W2 will continue to spin at its maximum rate for five additional characters and then begin its deceleration. When wheel W2 stops, wheel W3 will go for ten more characters and then begin to decelerate. To effect this operation, the randomizers and the wheel are independent until the wheels reach maximum speed. Once maximum speed is reached, the wheels will continue maximum speed until the respective randomizer overflows.

In the above manner, the outcome of each play is totally unpredictable by the player and statistically independent from any previous play. On the other hand, internally the play is strictly deterministic.

As stated before, FIG. 3 shows the screen of the video display 40 in its quiescent state. The particular symbols appearing depend upon how the previous game ended. To start the game, the player operates the enabling mechanism 34. This enables the symbol load circuit 37, permitting the player to select symbols for the sel ted symbol storage circuit 80, by pressing selected keys of the ASCI keyboard 36. Having made the selection, the player may then start the operation of the game by pulling the lever actuated start switch 24 which thereupon supplies a pulse through a gate 52 to the state sequencer 48 to cause it to move from its original state S0 to state S1.

The state sequencer 48 thereupon stops the cycling of the randomizers R1, R2 and R3 and enables the variable pulse rate generator 50, which provides pulses through gates 52 to accelerate the respective wheels W1, W2 and W3 to the maximum speed. The variable pulse rate generator 50 thereupon signals the state sequencer 48 through gates 52 to advance to state S2.

The state sequencer 48 then enables the randomizer R1 to count up until it overflows. The randomizer R1 thereupon supplies a pulse through a gate 52 to advance the state sequencer 48 to state S3.

The state sequencer 48 then enables the variable pulse rate generator 50, which provides pulses through a gate 52 to decelerate wheel W1. Wheels W2 and W3 continue spinning at maximum speed. The stopping of wheel W2 produces a pulse through a gate 52 to the state sequencer 48, advancing it to state S4.

The state sequencer 48 thereupon operates through a gate 52 to enable the randomizer R2 to count up until it overflows. The randomizer R2 thereupon supplies a pulse through a gate 52 to advance the state sequencer 48 to state S5.

The state sequencer 48 thereupon enables the variable pulse rate generator 50 to provide pulses to decelerate wheel W2, leaving wheel W3 at maximum speed. The stopping of wheel W2 provides a pulse through a gate 52 to advance the state sequencer 48 to state S6.

The state sequencer 48 thereupon acts through a gate 52 to enable the randomizer R3 to count up until it overflows, the randomizer R3 thereupon supplying a pulse through a gate 52 to advance the state sequencer 48 to state S7.

The state sequencer 48 thereupon enables the variable pulse rate generator 50 to produce pulses through a gate 52 to decelerate wheel W3. The stopping of wheel W3 produces a pulse acting through a gate 52 to advance the state sequencer 48 to state S8.

In state S8, the state sequencer 48 provides appropriate gating signals to enable the symbol comparator 58 to compare the respective characters in wheels W1, W2 and W3 with the symbols selected by the player, and to enable the payoff computation and control circuit 62 to make appropriate computations.

The selected symbol storage circuit 80, which stores the three letters selected by the player, comprises a cyclic 15-bit parallel in-parallel out shift register which maintains the three groups of five ASCII bits. It may be loaded by the player only during state S0 times between the operation of the enabling mechanism 34 and play initiation upon pulling the lever-actuated start switch 24. It is clocked such that the correct letter group of five bits) is available to the character generator and multiplexer 56 at the appropriate V1, V2 or V3 time.

The payoff computation is performed by a five-bit symbol comparator 58 which compares during a single raster scan (1/60 of a second) for each of V1, V2 and V3 whether the character on the payoff line is identical to the letter stored in the selected symbol storage circuit 80 and/or whether an asterisk (*) is displayed on wheel W1. The number of correct letter matches (0, 1, 2 or 3) is accumulated in the payoff computation and control circuit 62 and then, at the end of the vertical raster sweep during which the comparisons were made, the reward dispenser 44 is activated as appropriate.

The payoff computation and control circuit 62 also produces a stop signal which is applied to the enable and start circuit 49, which then operates to place the state sequencer 48 in state S0.

Figure 11:
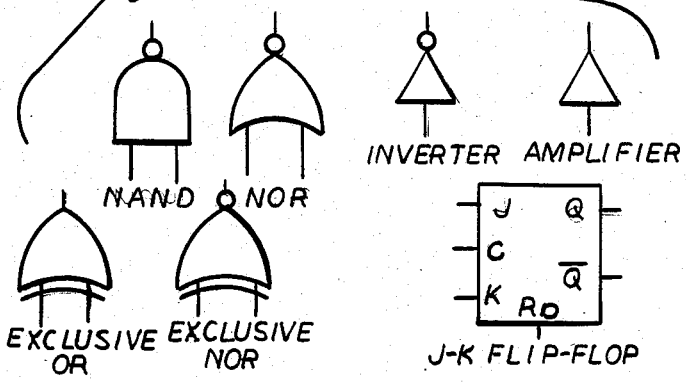
FIG. 11 is a diagrammatic illustration identifying the logic symbols used in the drawings.

As will be more fully understood and appreciated in considering the detailed circuitry of FIGS. 5 to 10, the block diagram of FIG. 4 does not indicate all of the connections between the various blocks. Rather, FIG. 4 shows such of the connections generally as are helpful in understanding the overall operation of the circuits. The circuits of FIGS. 5 to 10 utilize conventional logic symbols as indicated in FIG. 11. In addition, the following integrated circuits are indicated in the drawings by manufacturer's designation:

TMS 4103:ASCII 5×7 dot matrix character generator
7442:BCD-to-decimal (4 to 10) lines decoder
7451:dual 2-wide 2 input AND-OR-INVERT gates decode counter
7493:4-bit binary counter
7496:5-bit shift register
9316:4-bit 16-state presettable counter
74151:8-bit, with strobe data selector/multiplexer
74153:dual 4-line-to-1-line data selector/multiplexer
74161:4-bit 16-state presettable counter The circuits of FIGS. 5 to 10 are all part of the same device, comprising the various components illustrated more generally by the block diagram of FIG. 4, utilizing the same reference characters. Because of the simplification of the block diagram of FIG. 4, some of the components are distributed in different parts of the more detailed circuitry of FIGS. 5 to 10, the various parts being identified by an appropriate letter suffix. For example, part of the enable and start circuit 49 is identified on FIG. 5 by reference character 49A. Another part is indicated on FIG. 10 by reference character 49B. The various connections between the portions of the circuit shown in different figures are labeled generally by the function of the signals on the respective lines, or an abbreviation thereof.

Various parts of respective blocks will be indicated by numeral suffixes. For example, flip-flop 49A-1 is a flip-flop circuit in the enable and start circuit 49, which is operated by the enabling mecanism 34.

The various components of the circuit will be described in some detail; however, the above, more general description should be kept in mind as the description proceeds for a more complete understanding of how the entire circuit fits together.

Figure 6:
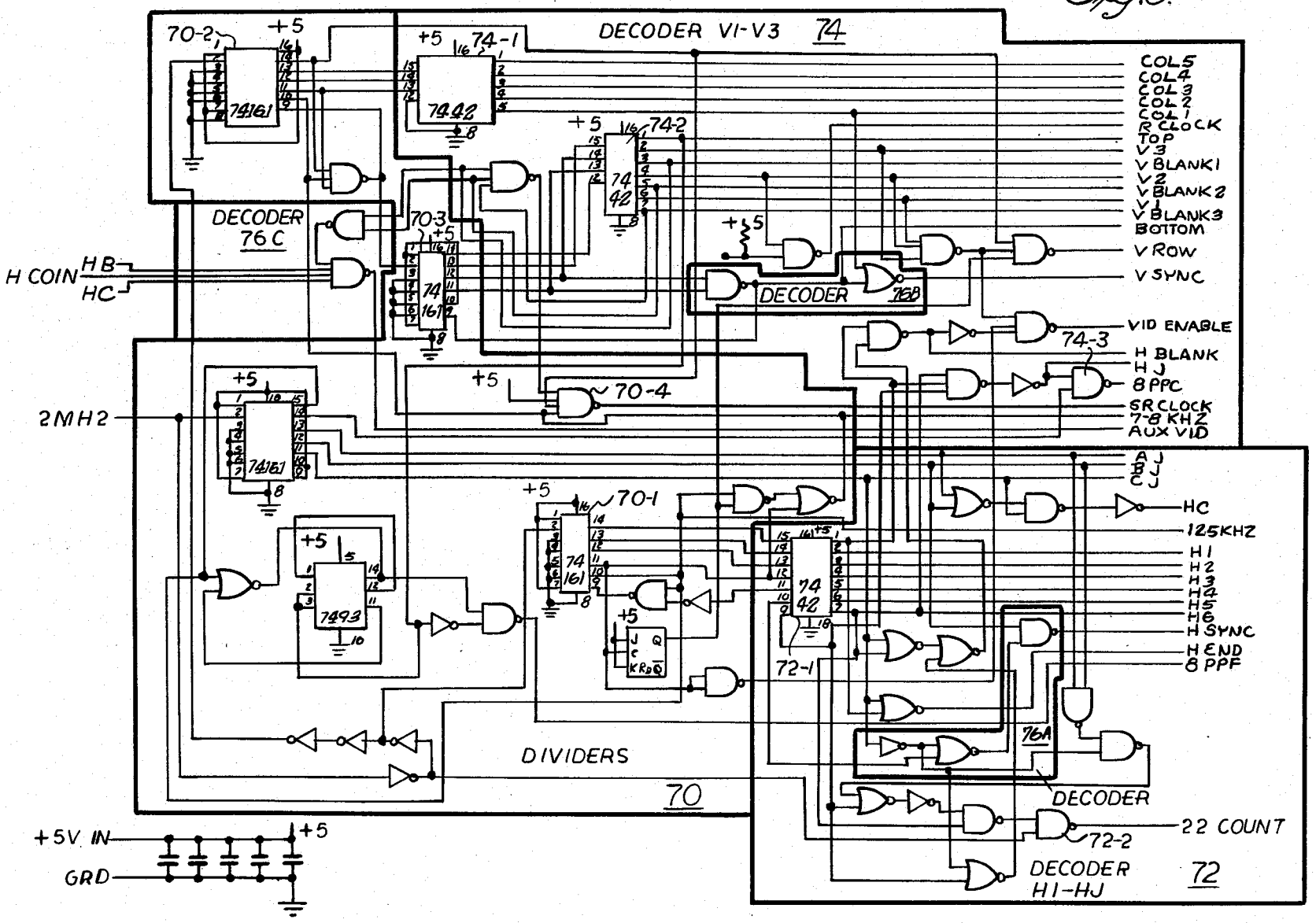

Crystal Clock 46, Divider Chain 70 and Decoders 72, 74 and 76 (FIG. 6)

The crystal clock 46 (FIG. 5) is composed of a conventional series resonant (0° phase shift) quartz crystal oscillator 46-1 operating at a frequency of 8.00 MHz. The output of the oscillator is divided in half by a flip-flop 46-2 to produce a 4 MHz timing signal, and this is further divided by a flip-flop 46-3 to produce a 2 MHz timing signal. All of the timing and synchronizing is coordinated by these pulses. The various control signals are developed from the clock output by the divider chain 70 and decoders 72, 74 and 76 shown in FIG. 6. The divider chain 70 divides the 2 MHz pulse rate by various desired factors to produce pulses at particular rates, synchronized with one another. These pulses, are, in general, applied to binary counters producing an output in binary form to a respective decoder for decoding. For example, divider 70-1 produces output pulses on four lines at an appropriate frequency which are applied to a decoder 72-1 which converts the signals to respective lines H1 to H6 and, by modification, HJ for synchronizing the horizontal slots H1 to H5 and HJ. This also produces, in connection with decoder 76A, the horizontal synchronizing signal H sync at the proper time and rate (15,600 PPS) The line pulse rate is divided by four to provide a signal corresponding to the four lines comprising each ASCII matrix dot and this signal is further divided by five by a counter 70-2, which produces an output in parallel binary form having five states, each corresponding to one of the five columns of the ASCII dot matrix. This signal is decoded by a decoder 74-1 to produce respective pulses indicating the respective columns of the ASCII dot matrix. The pulse rate is further divided by thirteen by a counter 70-3 to provide 13 states corresponding to the 13 vertical columns. This signal is decoded by decoder 74-2 to provide appropriate pulses corresponding to the respective vertical columns, in particular, including those corresponding to the columns V1, V2 and V3. The signal from the counter 70-3 is also decoded by a decoder 76B to produce the vertical synchronizing signal at 60 PPS. Output from the decoder 74-2 is also applied to decoder 76C which produces signals for producing the hyphens between the vertical columns V1, V2 and V3 to indicate the payoff line.

Figure 5:
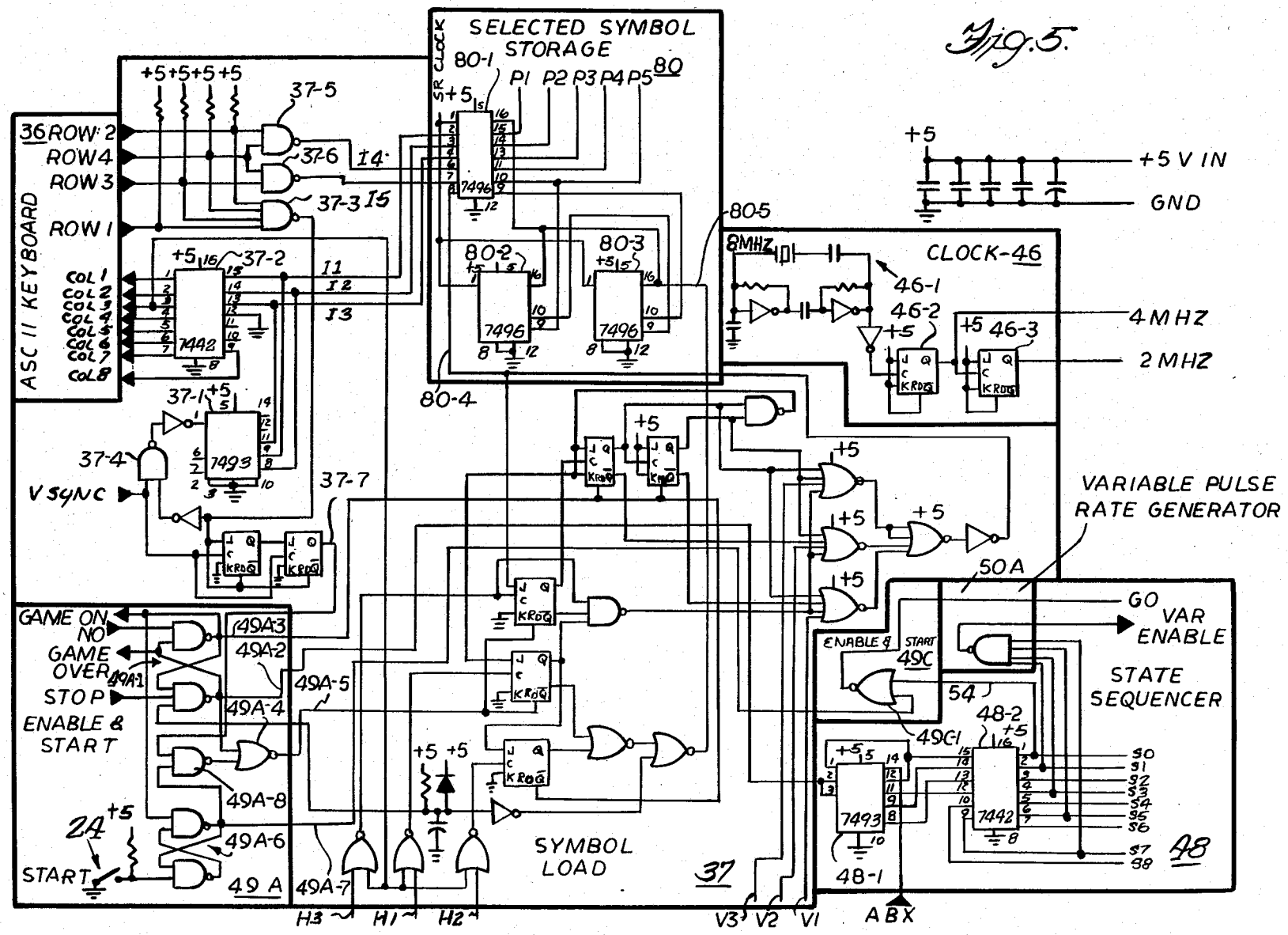
FIGS. 5 to 10 together provide a more detailed circuit diagram of the circuitry illustrated in FIG. 4, showing details of the circuits of various of the blocks of FIG. 4.
Figure 10:
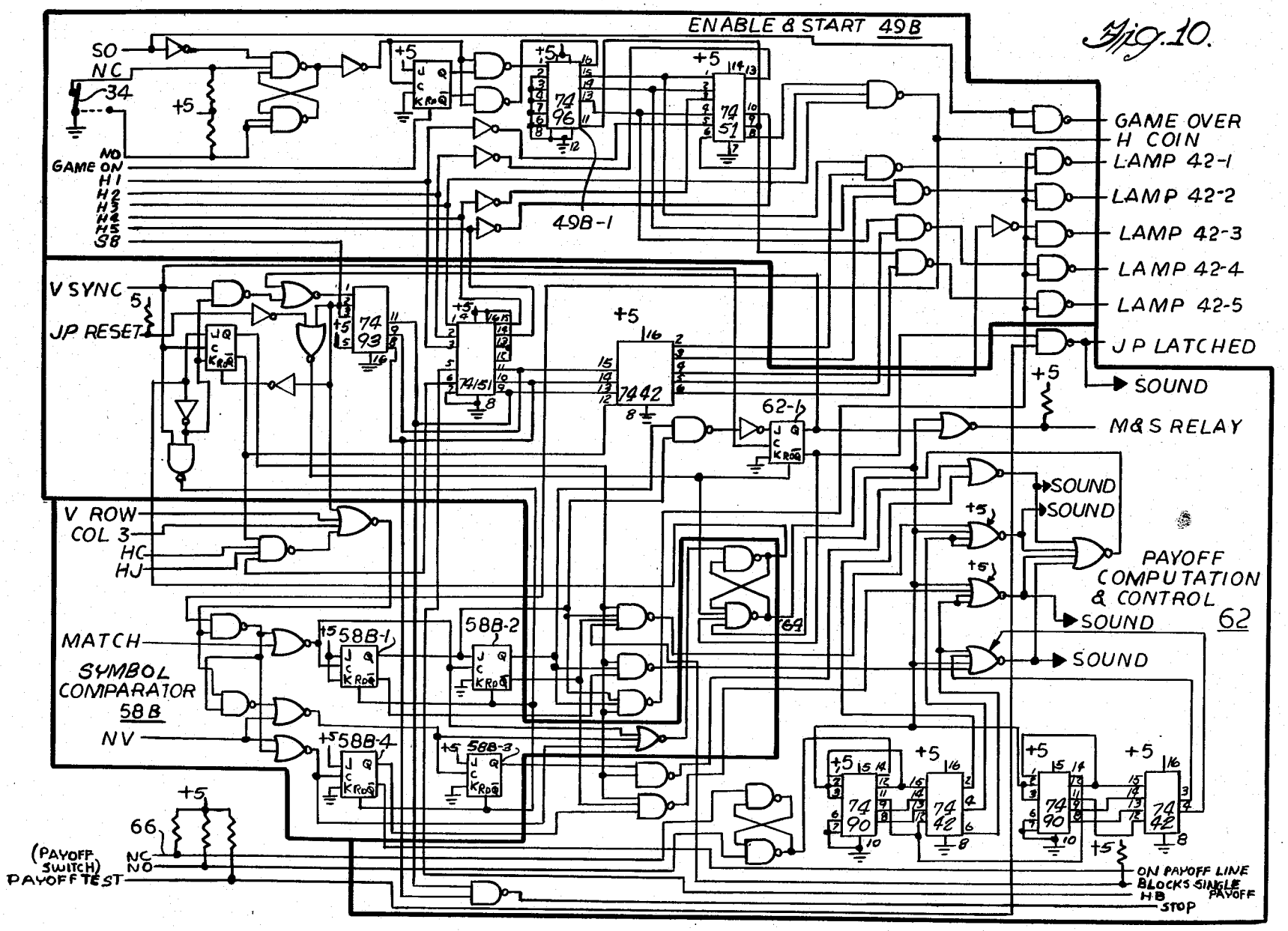

Enable and Start Circuit 49 (FIGS. 5 and 10)

The game is turned on by operating the enabling mechanism switch 34 (FIG. 10). This closes the normally open switch, producing a signal on line N0, each time the enabling mechanism 34 is operated. This operates the flip-flop 49A-1 (FIG. 5), developing a "game on" signal. A five bit shift register 49B-1 (FIG. 10) counts the number of times the enabling mechanism 34 is operated, up to five, and produces appropriate signals for lighting the various indicating lamps 42-1 to 42-5.

The last previous signal to the flip-flop 49A-1 was a STOP signal at the close of the previous game, Which provided appropriate reset signals on lines 49A-2 and 49A-3. Upon operation of the enabling mechanism 34, release or enabling signals are produced on lines 49A-2 and 49A-3, releasing respective circuits from reset. In addition, the flip-flop 49A-1 applies an enabling signal through gate 49A-4 to lead 49A-5 which releases resets in the symbol load circuit 37. The symbol load circuit 37 is then operative with the state sequencer 48 in state S0. State S0 comes to an end with the closing of the lever-actuated start switch 24 wiich operates a flip-flop 49A-6. The flip-flop 49A-6 operates through gates 49A-9 and 49A-4 to turn off the enabling signal to the symbol load circuit 37. Thus, symbols may be loaded into symbol load circuit 37 only during the interval between the operation of the enabling mechanism 34 and the operation of the lever-actuated start switch 24. A signal from the flip-flop 49A-6 is applied over a line 49A-7 to a gate 49C-1, which also receives a signal S0 over line 54 from the state sequencer 48. The combination of the two signals produces a signal on the line GO which is applied to a gate 52B-1 to produce an enabling signal. Upon the appearance of the next vertical sync signal, also applied to gate 52B-1, a pulse is applied through a gate 52B-2 to line ABX, which actuates the state sequencer 48 to advance it to state S1.

ASCII Keyboard 36, Symbol Load Circuit 37 and Selected Symbol Storage Circuit 80 (FIG. 5)

Meanwhile, during state S0, the symbol load circuit 37 being thus enabled, the player may select his winning combination by depressing the keys of the ASCII keyboard 36. The keyboard 36 has 26 Form A pushbuttons, one for each letter (but not for the asterisk), arranged as shown in FIG. 2. The pushbuttons actuate respective switches, wired into eight columns of four rows each, with each of the eight columns being interrogated sequentially at a sixty column per second rate by a 3-bit-8 state counter 37-1, operating in association with a 3 line-8 line decoder 37-2. When any pushbutton is depressed, the column scan is stopped by a signal applied through gate 37-3 to gate 37-4. The three bits defining the columns appear on lines I1, I2 and I3 at the output of the 3-bit-8 state counter 37-1. At the same time, the two bits defining the row in which the pushbutton it depressed appear on lines I4 and I5 which are the outputs of a decoder formed by gates 37-5 and 37-6. It should be noted that the columns and rows in which the pushbuttons are wired are not the same as the columns and rows of the mechanical arrangement of FIG. 2. Rather, the columns and rows are such that the signal indicating the respective columns and rows on lines I1 to I5 are the ASCII representations of the respective characters. Thus the ASCII representations of the characters corresponding to a depressed pushbutton are applied over lines I1 to I5 to a 5-bit shift register 80-1 in the selected symbol storage circuit 80. A pushbutton-closed signal from the agte 37-3, in association with a timing signal on line V SYNC, produces a strobe signal on a line 37-7 which operates through gates 49A-8 and 49A-4 to provide, in connection with the enabling signal from the flip-flop 49A-1, an appropriate signal to the symbol load circuit 37, whereby upon the appearance of an appropriate synchronizing signal, the ASCII representation on lines I1 to I5 is jam-loaded into the 5-bit shift register 80-1.

The selected symbol storage circuit 80 comprises three 5-bit shift registers, 80-1, 80-2 and 80-3. These shift registers are connected in a ring whereby the signals stored in register 80-1 are transferred, bit by bit, to register 80-2, whence the stored signals are transferred, bit by bit, to register 80-3, whence they are returned to register 80-1. The signals are thus shifted one station at a time repetitively through fifteen stations. The transfers of signals in the shift registers are effected by SR clock pulses, developed at gate 70-4. Gate 70-4 is programmed to supply five SR clock pulses during the vertical columns following columns V1, V2 and V3. Thus, after each character scan of a column V1, V2 or V3, five SR clock pulses applied to the respective shift registers 80-1, 80-2 and 80-3 advance the stored signals five positions around the ring. In other words, the five bits characterizing a character in one shift register are shifted to the next. The shift register 80-1 is the input shift register. The other two shift registers serve as a 10-bit clocked serial delay line. Because of the five SR clock pulses between vertical character fields, the cascaded shift registers are clocked so that the respective player-selected symbols are stored in the shift register 80-1 at the respective appropriate times to be displayed in the respective columns V1, V2 and V3 during the HJ time slot. This serial synchronous delay technique results in a much simpler character generator multiplexing than would, for example, a parallel storage array.

Returning now to the loading of the selected symbol storage circuit 80, upon operation of the enable mechasism 34, the symbol load circuit 37 is enabled, whereby pressing one of the keys of the ASCII keyboard 36 presents a corresponding ASCII representation of that character on lines I1 to I5. At an appropriate time, the five ASCII bits are jam-loaded into the shift register 80-1. For signal load synchronizing, signal H1, H2 and H3 and V1, V2 and V3 are applied to various gates and flip-flop circuits in the symbol load circuit 37. These synchronizing signal permit respective selected symbols to be stored in the selected symbol storage circuit 80 at the proper times. Entry of the first character into the shift register 80-1 at the same time acts to clear shift registers 80-2 and 80-3 to the 00000 state (displayed as an asterisk). The signals are cleared from shift registers 80-2 and 80-3 by a signal on line 80-5. ASCII representations of subsequently selected letters are also jam-loaded into the shift register 80-1, but at appropriate times when the prior information has been shifted on down the line. Load commands are applied to a line 80-4 to load the signals in the shift register 80-1 at the proper times. The first character is jam-loaded during the time of column V1, the second during the time of column V2 and the third during the time of column V3. Thereafter, the signals corresponding to the ASCII representations of the respective letters are available during the respective times V1, V2 and V3 on the lines P1, P2, P3, P4 and P5. These signals are transmitted to the character generator and multiplexer 56 at the appropriate times, as well as to the symbol comparator 58.

After three symbols have been loaded into the shift registers 80-1, 80-2 and 80-3, the symbol load circuit 37 is disabled, and the symbols may not thereafter be selected until the next game. Whether or not any or all three letters are selected by the player, the closing of lever-actuated start switch 24 operates through the gate 49A-8 to disable the symbol load circuit 37 to prevent the subsequent loading of symbol into the selected symbol storage circuit 80.

Figure 8:
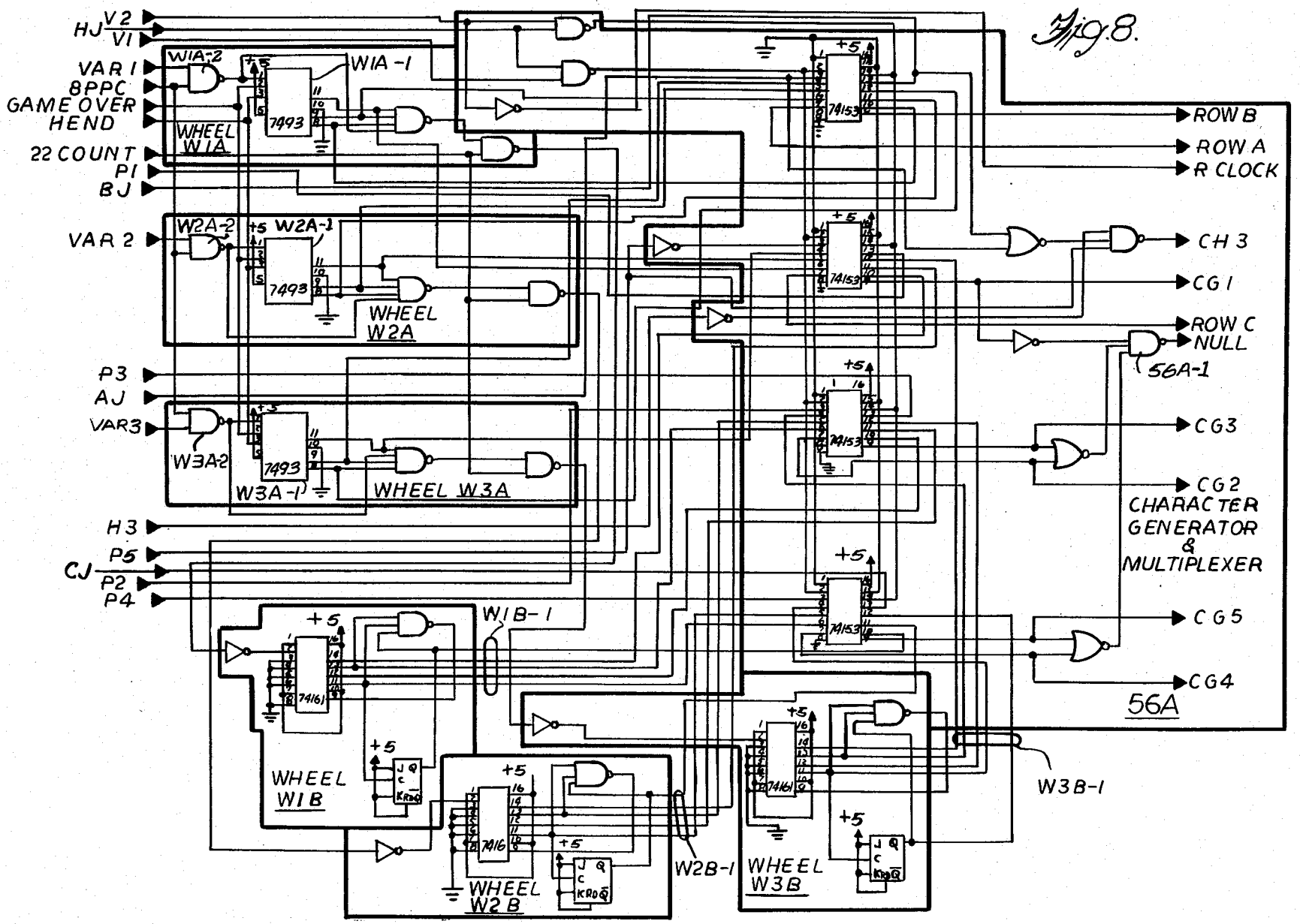

The Wheels W1, W2 and W3 (FIG. 8)

The three "wheels", or columns of five visible letters which "spin" during a play are electrically identical to one another. The operation of one will be described; the other two are similar. Each wheel includes a five-bit 27-state counter (0–26) W1B, W2B or W3B. The five output bits representing the count state are decoded as ASCII equivalent characters on lines W1B-1, W2B-1 or W3B-1. Each wheel counter is clocked from one of two sources: a fast pulse train consisting of 22 pulses from a gate 72-2 (FIG. 6) in the decoder H1-HJ 72 which occurs during HJ time and horizontal sync time to provide stability to the wheel display as described above, and from the output of a three-bit eight-state counter (0–7) W1A-1, W2A-1 or W3A-1. The eight-state counter in turn is clocked from one or two sources. In the quiescent condition (e.g., when no play is in progress), the eight-state counter is clocked at the horizontal square rate by the signal 8 PPC produced at a gate 74-3 (FIG. 6) in the decoder V1-V3 74 and applied to a gate W1A-2, W2A-2 or W3A-2. The state of the counter then represents which of the eight rows of the 5×7 wheel character is to be displayed at that moment. When the counter W1A-1, W2A-1 or W3A-1 overflows, the respective 27-state wheel counter W1B, W2B or W3B is incremented so that the display of the next character can begin on its rows 1–8. Five full characters (40 squares) are displayed in horizontal positions H1–H5. The 22 pulses mentioned above reset the wheel counters to their initial position for the next raster scan.

To make the wheels "spin", extra pulses are gated through the gate W1A-2, W2A-2 or W3A-2 into the respective eight-state counter clock line. Each such extra pulse will move the wheel character display up permanently and stably by exactly one square (i.e., one-eighth of the character height). These extra pulses are generated by the variable pulse rate generator 50 to be discussed below.

Each of the wheels has its own eight-state and 27-state counters so that it may be independent of the others. During spinning, the characters may not line up horizontally. At some moment, for example, at a given reference mark such as the payoff line hyphens, the third line of the 5×7 square matrix representation of a "U" might appear on the first wheel, the sixth line of an "R" on the second wheel, and the sixth line of an "L" on the third wheel. This happens, of course, because the wheels independently decelerate. When they stop spinning, all of the eight counters are synchronized so the letters are lined up. This is assured because the variable pulse rate generator 50 injects an exact multiple of eight pulses into each wheel counter network.

Figure 9:
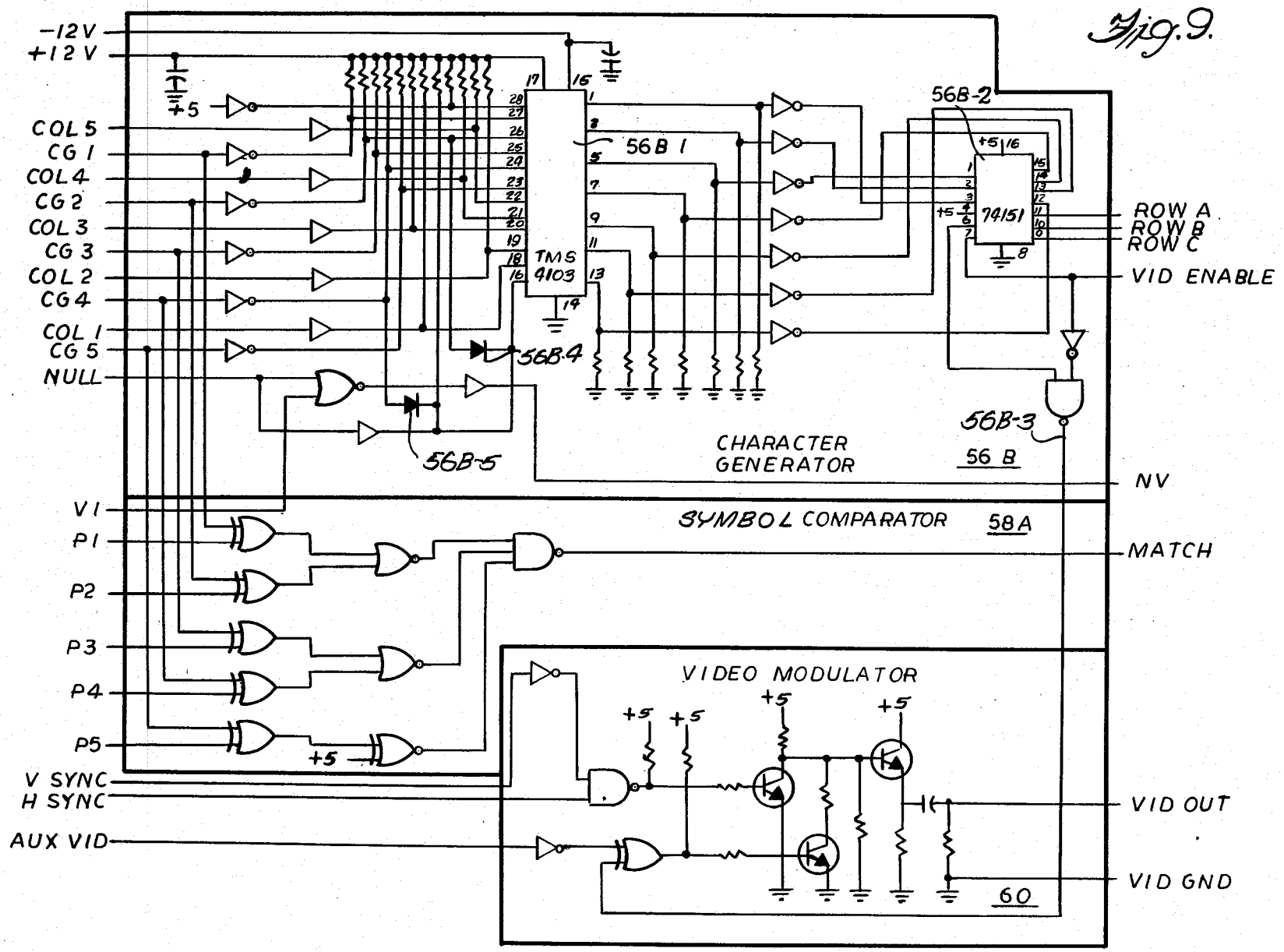

Character Generator and Multiplexer 56 (FIGS. 8 and 9)

Characters are generated on the video display through the use of an MOS 2240-bit read-only-memory 56B-1 in the form of a standard ASCII character generator integrated circuit TMS4103, organized to accept as inputs six lines defining the character (one out of 64 in the ASCII set) and five lines defining the current column (1–5) in the 5×7 square matrix. There are seven outputs which establish which of the seven squares in that column for that character are to be white. The seven character generator outputs are serialized in a parallel-serial converter 56B-2 and clocked out at the horizontal square rate. The resulting pulse train is applied over a line 56B-3 to the video modulator 60 to modulate a video composite signal which, together with the horizontal and vertical sync pulses, drive the video display 40.

Character generator 56 receives its column input signals on lines COL1–COL5 from the decoder 74-1 of the vertical timing chain 74 and its character ASCII data input signals from one of four sources: wheels W1, W2, W3, and the selected symbol storage circuit 80. This source selection is performed by a multiplexer 56A which gates the five ASCII bits on lines CG1–CG5 from wheel W1 at V1 time, wheel W2 at V2 time, and wheel W3 at V3 time. The selected symbol storage circuit outputs on lines P1–P5 are gated through with override at HJ time. The display is otherwise blanked except for payoff line hyphens, the signals for which are generated by the decoder 76C.

As mentioned above, ASCII "@", is represented by "00000", which is decoded as a special case as an asterisk (*). This is achieved using a NAND gate 56A-1 which senses a null or all "0's" on the lines CG1–CG5. The NULL signal is applied through diodes 56B-4 and 56B-5 to override the signals on lines CG2 and CG4 to convert the ASCII signal, with the input to terminal 16 of ASCII generator 56B-1, to the ASCII code for an asterisk, "0101010". This is then automatically decoded as an asterisk.

The ASCII generator 56B-1 decodes each ASCII input signal to 5 sets of 7, representing the 5×7 matrix for ASCII letters. The sets of 7 are applied one after the other in synchronism with the raster scanning, with the 7 squares of each column also synchronized, thus reproducing the respective letters at the proper positions on the display tube 40.

Figure 7:
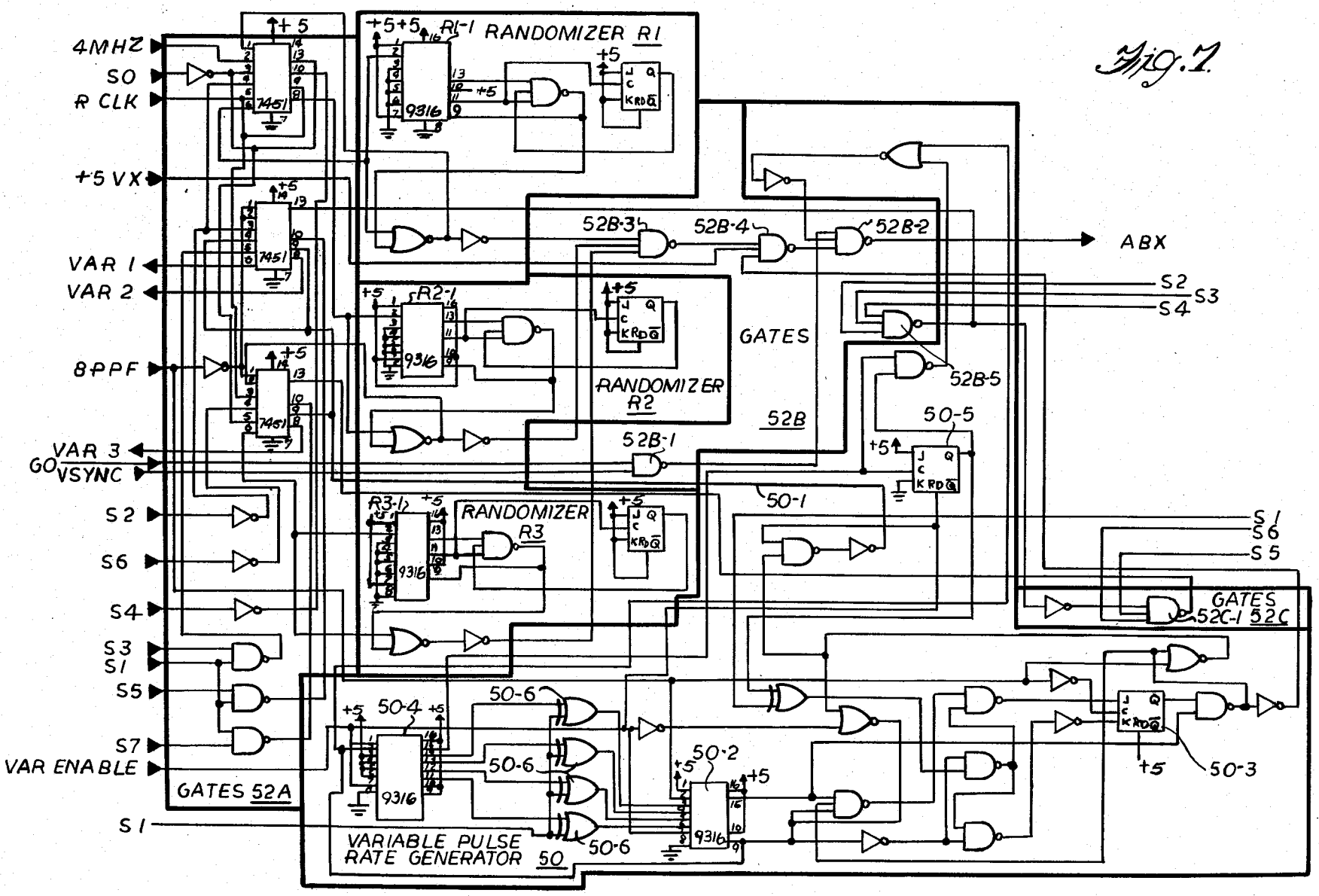

Randomizers R1, R2 and R3 (FIG. 7)

The function of the three randomizers R1, R2 and R3 was discussed above. They comprise 27-state counters (0–26) R1-1, R2-1, R3-1 which provide an output carry pulse at the 26—0 transition. During the time interval between plays, the first randomizer is driven at a four megabit per second rate; the second randomizer is driven by the carry pulse from the first; and the third from the carry pulse from the second. Thus they are connected in cascade. During a play, the input clocks are separated and each is separately driven, when appropriate, at the maximum wheel rotation character rate (60 PPS). The output carry pulse of each then initiates the deceleration of the corresponding wheel.

Timing signals for the randomizer are applied to gates 52A for switching the randomizers into the appropriate conditions at the proper times. During the interval between plays, the randomizers are driven by the 4 MHz signals, gated to randomizer R1 by the signal S0. Upon initiation of play by operation of the enabling mechanism 34, the state sequencer 48 is advanced to state S1, whereupon all randomizers are disconnected from any input signals and are therefore stopped in a random condition. During this interval S1, the wheels accelerate to full speed, whereupon the state sequencer 48 advances to state S2. The S2 signal applied to one of the gates 52A applies R CLK signals to the randomizer R1, which counts up to overflow and thereupon produces an output pulse applied through a gate 52B-3 and thence through a gate 52B-4 and thence through the gate 52B-2 to line ABX to advance the state sequencer 48 to state S3. Randomizer R1 is then disconnected from the R CLK pulses and remains in its final state until the game is over and the state sequencer 48 returns to state S0. Similarly, randomizers R2 and R3 are fed by R CLK pulses during states S4 and S6, respectively, and upon overflowing, apply pulses through the gates 52B-3, 52B-4 and 52B-2 to advance the state sequencer 48 to its next state. Thus, the sole function of each randomizer is to generate a random time interval, which introduces random delays in the advancing of the state sequencer 48, whereby deceleration of the respective wheels and hence the stopping of the respective wheels occur randomly. This assures the randomness of the characters appearing on particular payoff lines.

Variable Pulse Rate Generator 50 (FIG. 7)

The variable pulse rate generator 50 is used to produce the "extra" pulses to the wheel counters to cause the display of each wheel to accelerate linearly upward, "spin" at a maximum speed of 60 characters/second, and decelerate linearly back to a rest velocity of zero. The process works in the following sequence: during sequencer state S1, all three wheels are accelerated together by application of the S1 signal to gates 52A whereby a pulse train with a pulse repetition frequency increasing from zero to eight pulses per video frame (eight pulses per sixtieth of a second) is gated over all of lines VAR1, VAR2 and VAR3 to the respective eight-state wheel counters W1A-1, W2A-1 and W3A-1, resulting in a terminal velocity of 60 characters/second. When the variable pulse rate generator 50 has reached this maximum, the S2 signal is applied to gates 52A and 52B, whereby an eight-pulse-per-frame signal (8 PPF) from the main timing chain dividers 70 (FIG. 6) is gated over all of these lines VAR1, VAR2 and VAR3 to the respective wheel counters to maintain that terminal rotation speed. When the time comes to decelerate a wheel, the eight-pulse-per-frame (8 PPF) signal is removed, and the variable pulse rate generator is reconnected. This time, however, the starting pulse rate is 8 PPF and decreases to zero.

When the first randomizer R1 overflows and advances the state sequencer 48 to state S3, the S3 signal applied to a gate 52A connects the output of the variable pulse rate generator 50 to a line VAR1 and thence to wheel counter W1A-1, decelerating wheel W1. Meanwhile, and continuing through state S4, the eight-pulse-per-frame signal remains applied to line VAR2 by operation of a gate 52B-5. Similarly, during state S5, the signal S4 applied to a gate 52A couples the variable pulse rate generator 50 to line VAR2 for slowing down wheel W2. Wheel W3 remains at full speed through state S6 by operation of a gate 52C-1 which applies the eight-pulse-per-frame signal to line VAR3. In state S7, the S7 signal applied to a gate 52A connects the output of the variable pulse rate generator 50 to line VAR3 for slowing down the third wheel W3. Each wheel stops with a respective letter centered on each of the lines H1 to H5 by reason of the fact that the added pulses are in total divisible by eight. Upon the stopping of the wheels, no more extra pulses are applied over the respective lines VAR1, VAR2 and VAR3, and the wheels remain stationary.

The variable pulse rate generator 50 is therefore called upon to produce a pulse train either increasing linearly in frequency from zero to 8 PPF or decreasing linearly from 8 PPF to zero. The total number of pulses is divisible by eight.

These objectives are achieved for acceleration by letting a five-bit 32-state counter "count itself up" with the 8 PPF clock pulses. It is clocked at 8 PPF. When it overflows, a pulse is delivered to the respective wheel counter over line 50-1 through a respective gate 52A as enabled by a respective state signal. An output pulse is also delivered to a second 32-state counter which counts the number of times the first 32-state counter overflows. The first 32-state counter comprises a counter 50-2, a JK flip-flop 50-3 and associated gate circuits. The second 32-state counter comprises a counter 50-4 and a JK flip-flop 50-5. The output of the second 32-state counter is jam-loaded into the first 32-state counter after each output pulse.

For acceleration, the first 32-state counter starts at 0 (00000). With each output pulse, it is jam-loaded to one higher count, beginning with 1 (00001) and repeating up to 31 (11111), whereat the overflow occurs at the input clock frequency of 8 PPF. In other words, the respective wheel counter is clocked once every 30, 31, . . . 3, 2, 1 input clock pulses, resulting in the desired linear acceleration. The acceleration in fact proceeds in increments, but each step is small enough that the overall effect is substantially linear.

For wheel deceleration, the first 32-state counter starts at 31 and "counts itself down" to zero, yielding the desired deceleration. As the jam-loading of the first 32-state counter is performed through exclusive OR gates 50-6, the counting down is achieved by application of the S1 signal to these gates, effectively inverting the jam-loaded signals, resulting in counting down rather than counting up. Upon completion of the respective count up or count down, the final overflow pulse produces a signal through gates 52B-4 and 52B-2 onto line ABX for advancing the state sequencer 48.

Note that the acceleration and deceleration are digitally strictly deterministic; there is no dependence upon analog timers, ramps, or other approaches which can cause unpredictable or erratic performance.

State Sequencer 48 (FIG. 5)

The state sequencer 48 comprises a four-bit nine-state counter 48-1 whose outputs are decoded with a four-line to nine-line decoder 48-2 to give the required state outputs. The counter is advanced in accord with the events tabulated above by pulses applied on line ABX.

Symbol Comparator 58 and PayoCff Computation and Control 62 (FIGS. 9 and 10)

When the state sequencer 48 advances to state S8 (i.e., when the last wheel W3 stops), the symbol comparison and payoff occur. The process is tied to the video display vertical sweep. During the first vertical sweep (1/60 second), the characters on the first display row H1 are compared to the player-selected characters. The character at H1-V3 (see FIG. 3) is compared through a five-bit exclusive OR network with the character HJ-V3. If they match and if row H1 is a payoff line, a two-bit three-state counter comprising JK flip-flops 58B-1 and 58B-2 is incremented by one count. Then as the vertical sweep comes to column V2, the character at H1-V2 is compared with the character at HJ-V2. If they match and row H1 is a payoff line, the counter 58B-1, 58B-2 is incremented. As the sweep crosses V1, H1-V1 is compared to HJ-V1, and the counter 58B-1, 58B-2 is incremented if they match and H1 is a payoff line. The character at H1-V1 is also checked to see if it is an asterisk (*). If it is and H1 is a payoff line, a latch 58B-3 is set. If it is and H1 is not a payoff line, another latch 58B-4 is set. At the completion of the vertical sweep, if the two-bit counter 58B-1, 58B-2 is non-zero and/or if either of the asterisk latches is set, the player is entitled to a reward. If the two-bit counter contains a count of one, the player has correctly predicted one character right. If it contains two, two letters have been called, and if it contains three, the player has scored a jackpot. Detection of a jackpot sets a special latch 62-1 and disables further machine operation until reset by a signal at line JP RESET.

If a non-jackpot payoff is in order, the reward mechanism 44 which may include win lights, sound effect and individual rewards is activated. The reward may be monitored by a payoff switch which closes upon each individual reward, providing a count for counting down the programmed reward for the particular payoff, until the programmed payoff is reached.

When the payoff is completed, or if no payoff is appropriate (no match), the counters 58B-1, 58B-2 and latches 58B-3 and 58B-4 are reset and the next vertical sweep causes a comparison on row H2. The same process is followed on through rows H3, H4 and H5. Completion of the comparison-payoff process on line H5 signals an end to the current play on line STOP and resets flip-flop 49A-1 and thereby the latches and counters coupled thereto, including resetting the state sequencer 48 to state S0 in anticipation of the next play.

Although an illustrative embodiment of the invention has been shown and described, it is to be understood that various modifications and substitutions may be made by those skilled in the art without departing from the novel spirit and scope of the invention.

What is claimed is:

1. An electronic slot machine which comprises a cathode ray tube, means for displaying a plurality of symbols of each of a plurality of sets of symbols on said cathode ray tube, means for selecting at least one combination of winning symbols and producing winning symbols signals corresponding thereto, means for moving the displayed symbols of each set on said cathode ray tube along a respective predetermined path in simulation of the wheels of a mechanical slot machine, said respective paths being parallel to one another, means including randomizing means for stopping the motion of the displayed symbols with a random one of said displayed symbols of each set at a predetermined position along said paths, means for producing displayed symbol signals corresponding to the symbols displayed at said predetermined positions, comparison means for comparing said displayed symbol signals to said winning symbol signals to find matches between the symbols stopped at said predetermined position and respective ones of said selected at least one combination of winning symbols, and reward means responsive to said comparing means for providing a reward when said comparing means finds at least one symbol match.

2. An electronic device according to claim 1 wherein said means for moving the displayed symbols accelerates the symbols of the respective sets together substantially linearly from zero velocity to a predetermined terminal velocity, and said means for stopping the motion decelerates said symbols substantially linearly from said terminal velocity to zero, with the deceleration of each set beginning at a different randomly determined time.

3. An electronic device according to claim 1 wherein said reward means provides greater rewards for a greater number of matching symbols.

4. An electronic device according to claim 1 including means operable by said player for selecting a plurality of said predetermined positions.

5. An electronic device according to claim 1 wherein all symbols stop at said predetermined position with equal probability.

6. An electronic device according to claim 1 wherein all of said plurality of sets of symbols are alike.

7. An electronic device according to claim 1 including a lever arm pivotally coupled to a side of said electronic device for initiating the motion of said symbols.

8. An electronic device according to claim 1 wherein said symbols comprise letters of the alphabet.

9. An electronic device according to claim 1 wherein said means for displaying includes means for generating said symbols to follow one another in predetermined sequence.

10. An electronic device according to claim 1 wherein said selected symbols are digitally stored in shift register means.

11. An electronic device according to claim 1 wherein said means for selecting a winning symbol is operable by the player of said electronic device.

12. An electronic device according to claim 11 wherein said means for selecting a winning symbol includes a manually operable keyboard accessible to the player.

13. An electronic device according to claim 1 including means for displaying said selected winning symbols on said cathode ray tube.

14. An electronic device according to claim 13 wherein three of said sets of symbols are displayed, said paths are vertical, said stopped symbols are horizontally aligned at said predetermined position, and said winning symbols are displayed on said cathode ray tube in vertical alignment with respective sets of displayed signals and in horizontal alignment with each other.

15. An electronic device according to claim 1 wherein said means for moving provides a simulated rolling effect to the symbols displayed on said cathode ray tube.

16. An electronic device which comprises a cathode ray tube, means for displaying a plurality of symbols of each of first, second and third sets of symbols on said cathode ray tube, an enabling mechanism, means for selecting a respective winning symbol in respect to each of said sets, start means, means for substantially linearly accelerating the displayed symbols of each set on said cathode ray tube along respective predetermined vertical paths from zero to a predetermined constant velocity, first, second and third random delay means, means for substantially linearly decelerating the motion of the displayed symbols of each respective set to stop with one of said displayed symbols of the respective set stopped at a predetermined position along said paths, the stopped symbols being horizontally aligned, means for comparing the symbols stopped at said predetermined position with respective ones of said selected winning symbols, reward means responsive to said comparing means for providing a reward when said comparing means finds at least one symbol match, and state sequencing means including a nine-state counter having a starting state S0 and eight successive timing states S1 to S8 wherein said first, second and third random delay means are randomized in state S0 and wherein said means for selecting is enabled in state S0 by operation of said enabling mechanism, said state sequencing means being advanced to the first timing state S1 by operation of said means, said state sequencing means providing respective timing signals during states S1 to S8 to time the operation of respective ones of the above means in the sequence:

S1. enable said accelerating means until said sets of symbols attain said constant velocity,

S2. enable said first random delay means for the period of a first random delay,

S3. enable said means for decelerating said first set of symbols until said first set stops moving,

S4. enable said second random delay means for the period of a second random delay, S5. enable said means for decelerating said second set of symbols until said second set stops moving, S6. enable said third random delay means for the period of a third random delay, S7. enable said means for decelerating said third set of symbols until said third set stops moving, S8. enable said comparing means and said reward means until said reward is complete, said state sequencing means being advanced to its next state by the respective enabled means upon completion of the respective function.

17. An electronic device which comprises a cathode ray tube, means for displaying a plurality of symbols of a set of symbols on said cathode ray tube, means for selecting a winning symbols, means for moving the displayed symbols on said cathode ray tube along a predetermined path, means including randomizing means for stopping the motion of the displayed symbols with a random one of said displayed symbols at a predetermined position along said path, means for comparing the symbol stopped at said predetermined position with said selected winning symbol, and reward means responsive to said comparing means for providing a reward when said comparing means finds the symbols to match, wherein said means for displaying includes an ASCII character generator, and means for decoding an ASCII null signal as an asterisk.

18. A symbol display for an electronic device which comprises a cathode ray tube, means for displaying a plurality of symbols of a set of symbols on said cathode ray tube, means for moving the displayed symbols on said cathode ray tube along a predetermined path, and means including randomizing means for stopping the motion of the displayed symbols with a random one of said displayed symbols at a predetermined position along said path, wherein said means for displaying includes an ASCII character generator, and means for decoding an ASCII null signal as an asterisk.

19. A symbol display for an electronic device which comprises a cathode ray tube, means for displaying a plurality of symbols of each of a plurality of sets of symbols on said cathode ray tube, means for moving the displayed symbols of each set on said cathode ray tube along a respective predetermined path, said respective paths being parallel to one another, and means including randomizing means for stopping the motion of the displayed symbols with a random one of said displayed symbols of each set at a predetermined position along said paths, wherein said means for displaying includes an ASCII character generator, and means for decoding an ASCII null signal as an asterisk.

20. An electronic slot machine which comprises a cathode ray tube, means for displaying a plurality of symbols of each of a plurality of sets of symbols on said cathode ray tube, means for selecting at least one combination of winning symbols and producing winning symbol signals corresponding thereto, means for moving the displayed symbols of each set on said cathode ray tube along a respective predetermined path in simulation of the wheels of a mechanical slot machine, said respective paths being parallel to one another, means including randomizing means for stopping the motion of the displayed symbols with a random one of said displayed symbols of each set at a predetermined position along said paths, means for producing displayed symbol signals corresponding to the symbols displayed at said predetermined position, comparison means for comparing said displayed symbol signals to said winning symbol signals to find matches between the symbols stopped at said predetermined position and respective ones of said selected at least one combination of winning symbols, and reward means responsive to said comparing means for providing a reward when said comparing means finds at least one symbol match, said means for displaying including an ASCII character generator.

21. An electronic device according to claim 20 including means for decoding an ASCII null signal as an asterisk.

22. An electronic slot machine which comprises a cathode ray tube, means for displaying a plurality of symbols of each of a plurality of sets of symbols on said cathode ray tube, means for selecting at least one combination of winning symbols and producing winning symbol signals corresponding thereto, means for moving the displayed symbols of each set on said cathode ray tube along a respective predetermined path in simulation of the wheels of a mechanical slot machine, said respective paths being parallel to one another, means including randomizing means for stopping the motion of the displayed symbols with random one of said displayed symbols of each set at a predetermined position along said paths, means for producing displayed symbol signals corresponding to the symbols displayed at said predetermined position, comparison means for comparing said displayed symbol signals to said winning symbol signals to find matches between the symbols stopped at said predetermined position and respective ones of said selected at least one combination of winning symbols, and reward means responsive to said comparing means for providing a reward when said comparing means finds at least one symbol match, said symbols available for display on the cathode ray tube including a "wild" symbol for which the player cannot select a corresponding winning symbol, and said comparing means including means for sensing the display of said "wild" symbol after the motion of the symbols has stopped.

* * * * *